United States Patent [19]

Murphy et al.

[11] 4,135,679

[45] Jan. 23, 1979

[54] MEANS FOR CONTROLLING A WIRE DISCHARGED FROM A FLYER PAYOFF

[75] Inventors: Thomas A. Murphy, Taunton, Mass.; Richard E. Long, Riverside, R.I.; Kenneth L. Tebo, Dudley, Mass.

[73] Assignee: The Entwistle Company, Hudson, Mass.

[21] Appl. No.: 871,208

[22] Filed: Jan. 23, 1978

[51] Int. Cl.[2] ..... B65H 49/00

[52] U.S. Cl. ..... 242/128; 242/151

[58] Field of Search ..... 242/128, 147 R, 151, 242/152, 155 R; 57/106-108; 226/189; 72/183

[56] References Cited

U.S. PATENT DOCUMENTS

| | | | |
|---|---|---|---|
| 2,655,325 | 10/1953 | Kuettler, Jr. et al. | 242/151 |
| 2,963,240 | 12/1960 | Jackson et al. | 242/128 |
| 3,054,572 | 9/1962 | Williams et al. | 242/86.7 |
| 3,879,978 | 4/1975 | Harris, Jr. | 72/183 |

*Primary Examiner*—Leonard D. Christian
*Attorney, Agent, or Firm*—Barlow & Barlow

[57] ABSTRACT

A wire line includes a flyer payoff and means for controlling the wire discharged from the flyers payoff by a tension system comprising two spaced tensions, the first of which comprises two groups of rolls with the rolls of one group staggered with relation to the rolls of the other group with the groups relatively movable toward and from each other to apply more or less tension on the wire as it leaves the flyer payoff with the tension system also including a second tensioning means comprising a drum and a guide sheave spaced therefrom about which the wire is passed with sufficient surface engagement with the drum and sheave so that they will rotate as the wire passes thereover rather than the wire slip on either, and then applying a friction drag on the drum to retard the rotation and apply a greater amount of tension before the wire passes on to a point to be serviced.

4 Claims, 5 Drawing Figures

MEANS FOR CONTROLLING A WIRE DISCHARGED FROM A FLYER PAYOFF

Background of the Invention

In the use of flyer payoffs particularly the type disclosed in the Duff U.S. Pat. No. 3,131,884 of May 5, 1964, the wire as it leaves the payoff is very unruly. A drum-type tension, which in principle works similar to that in U.S. Pat. No. 3,054,572, has been found not to work alone and also the roll type tension which is here disclosed is also found not to work alone to supply a sufficient control on the wire in passing it from the flyer payoff to its point of further service.

Specifically, when using flyer payoffs in a "wire line" that covers the bare wire, the linear speed of the wire leads to pulsations that are unacceptable to an extruder that covers the bare wire. The pulsations effectively yield a poor insulating cover on the wire as it exits the extruder.

SUMMARY OF THE INVENTION

A wire line that is initiated from a flyer payoff is provided with two tensions one after the other, the first being that of groups of rolls which are arranged so that the rolls of one group are staggered with relation to the rolls of the other group with these rolls movable toward and from each other to apply varying amounts of tension on the wire, and then following it by a tension stand in which the wire is passed about a drum and a small sheave spaced therefrom a sufficient number of times to prevent slipping of the wire on the drum and then applying a friction drag on the drum to retard its rotation. The wire is then carried to the point of service with sufficient control on the wire, while the use of either of these devices without the other through varying amounts of drag will not be satisfactory to provide the control desired.

DESCRIPTION OF THE PREFERRED EMBODIMENT

Figure 1:
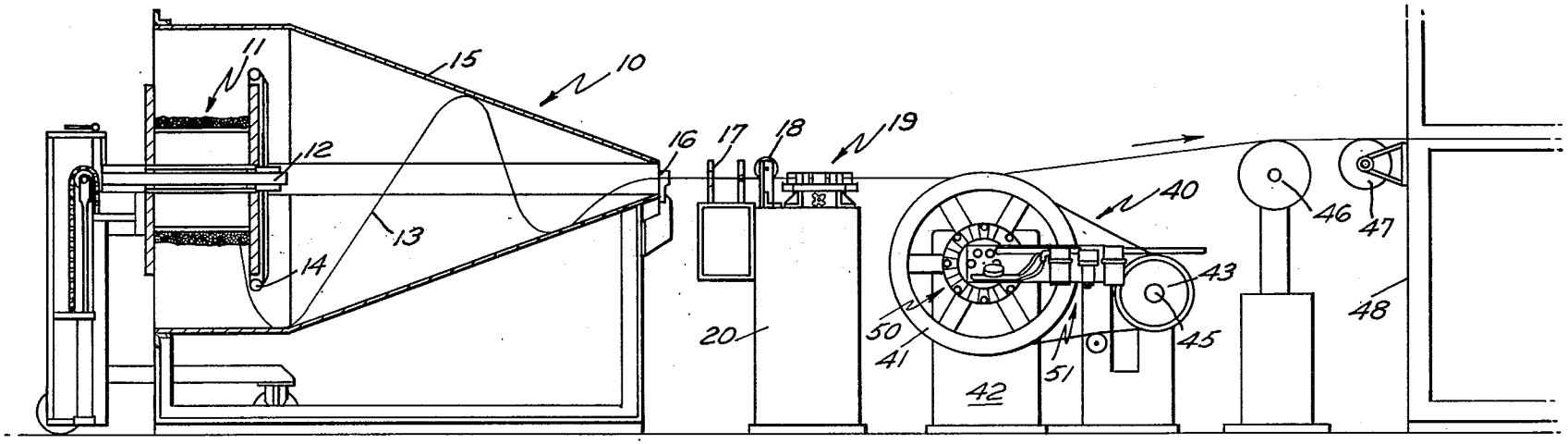
FIG. 1 is an elevation showing a flyer payoff and the two tandemly related tensioning means.

Referring particularly to FIG. 1, there is shown a portion of a wire line for insulating wire loaded in a flyer payoff 10 such as is described in greater detail in the patent to Duff U.S. Pat. No. 3,131,884 of May 5, 1964. This comprises in general a spool of wire 11 which is mounted on an axis 12 with the wire 13 drawn from the spool over the edge of head 14 thereof as a guide. This wire balloons as pulled from the spool and, as indicated in FIG. 1, is controlled to some extent by a conical casing 15 with an exit mouth 16 through which the wire discharges. The wire then passes through guides 17 and under a guide sheave 18 to a first tensioning means 19 supported on a stand 20.

Figure 3:
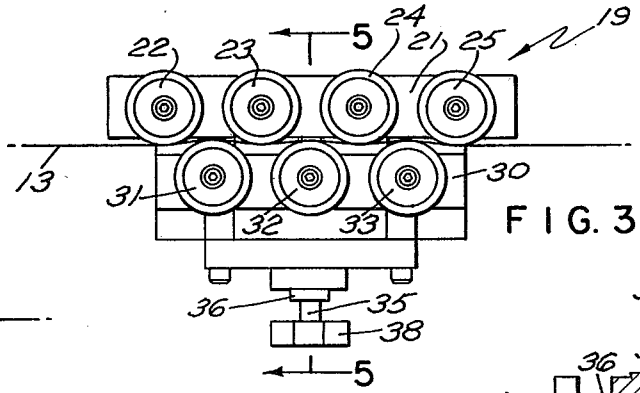
FIG. 3 is a top plan view of the two group roll tensioning means.
Figure 5:
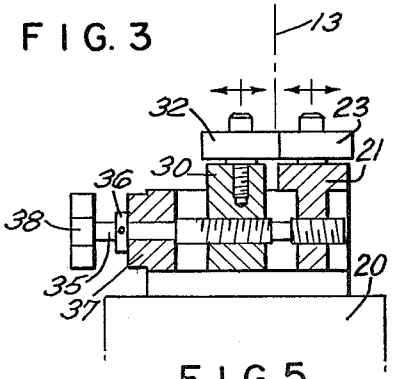
FIG. 5 is a section on substantially line 5—5 of FIG. 3.
Figure 4:
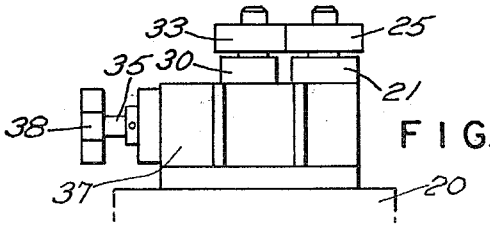
FIG. 4 is an end view looking at the righthand end of FIG. 3 of the roll tensioning means.
Figure 2:
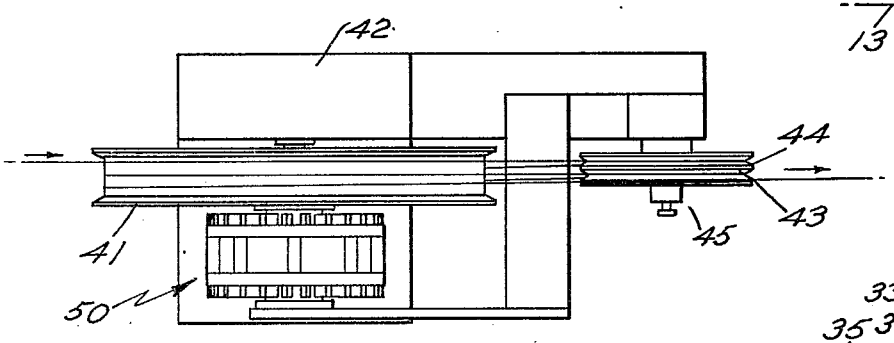
FIG. 2 is a top plan view of the drum tensioning means.

This first tensioning means 19 comprises a carriage 21 (FIG. 3) having a first group of aligned rolls 22, 23, 24 and 25 with parallel axes rotatably mounted thereon. A second group of rolls has a carriage 30 carrying rolls 31, 32, 33 on parallel axes also parallel to the axes of the first group of rolls located in lateral staggered relation or between the other groups of rolls 22 to 25 as may be seen in FIG. 3. Both carriages 21, 30 are movable toward and from the common wire center line 13 by means of a right and left hand threaded shaft 35 passing through a fixed supporting body 37 (FIG. 5) and held by collar 36. Thus, the wire 13 which passes between the rolls and which may be seen in FIG. 3 contacts first the roll 22, and then the roll 31 on opposite sides, and then roll 23, then roll 32, and then roll 24 and then roll 33, and then roll 25 as it passes through this tensioning means. The wire touches each of these rolls in substantially tangential relation and tension may be varied by moving the group of rolls on the carriages 30 and 21 to provide a more or less zigzag path for the wire as it passes through this tensioning means. In practice, we have found that the tension applied by these tensioning rolls will be between 1 to 2 lbs. maximum before deformation of the wire occurs.

After the wire passes through this first tensioning means, it moves into a tensioning stand designated generally 40 which comprises a drum 41 rotatably mounted upon a stand 42 with a pair of sheaves 43 and 44 on an axis 45 spaced from the axis of the drum 41. The wire is led from the tensioning means 19 over the drum 41 and then about a sheave 44, then back under the drum 41, and then over the drum 41 and then about the sheave 43 and then back under the drum 41 and over the drum 41 and then on its way as shown in FIG. 1 to a guide pulley 46 and then over another guide 47 and into a machine for further processing the wire designated 48 and which may consist of a preheater usual in the practice or to any other machine for processing the wire.

The wire as it passes about the drum 41 and sheaves 43 and 44 is wrapped about these sufficiently so that it will not slip along the surfaces of either but will cause them to rotate as the wire is passed about the tension stand and then onto its further processing. In order to place a drag upon the passage of the wire in this fashion, we have provided a disc brake designated generally 50 to which pressure may be applied by some fluid means designated generally 51 and which may be controlled by hand with a pressure indicating gauge to apply the pressure desired and provide a drag on the drum. We have found that the application of 15 to 20 lbs. of fluid pressure at this point provides about the right tension for the control of the wire. It will be understood, other forms of brake devices, as for example, eddy current brakes may be substituted.

As before stated, the two tensions as above described have been found to provide satisfactory control of the unruly wire as it is discharged from the flyer payoff while the use of either one along without the other has not been able to do the work regardless of tension applied. Apparently, the first tension of a lesser amount and a second tension of a greater amount we have discovered is necessary in order to control this highly uncontrollable wire from the flyer payoff.

We claim:

1. In combination with a flyer payoff, means for controlling the wire discharged from the flyer payoff comprising a first tensioning means including two groups of generally aligned rolls on parallel axes with the rolls of one group in lateral staggered relation with reference to the rolls of the other group and movable laterally toward the rolls of said other group to engage a wire passing through said groups at spaced locations and alternately on opposite sides of the wire, a second tensioning means comprising a tension stand having a drum and a guiding means spaced from the drum about both of which the wire passes sufficiently to be in non slip relation with the drum and then passes on to its point of service, and brake means to retard the rotation of said drum and tension the wire passing about said tension stand.

2. Means as set forth in claim 1 wherein there are means to move said group of rolls toward and from each other.

3. Means as set forth in claim 1 wherein the brake means to retard said drum is variable.

4. Means as set forth in claim 1 wherein the brake means to retard said drum is a friction brake.

* * * * *